US011760445B1

(12) United States Patent
Stevens

(10) Patent No.: US 11,760,445 B1
(45) Date of Patent: Sep. 19, 2023

(54) FLOATATION DEVICE

(71) Applicant: Zachary Jon Stevens, Grove, OK (US)

(72) Inventor: Zachary Jon Stevens, Grove, OK (US)

( * ) Notice: Subject to any disclaimer, the term of this patent is extended or adjusted under 35 U.S.C. 154(b) by 236 days.

(21) Appl. No.: 17/465,308

(22) Filed: Sep. 2, 2021

(51) Int. Cl.
*B63B 34/50* (2020.01)
*B63B 5/00* (2006.01)
*B63C 9/15* (2006.01)

(52) U.S. Cl.
CPC ..... *B63B 34/50* (2020.02); *B63B 5/00* (2013.01); *B63C 9/15* (2013.01)

(58) Field of Classification Search
CPC ..... B63B 34/00; B63B 34/50; B63B 5/00; B63C 9/00; B63C 9/15
USPC ..... 441/108, 129
See application file for complete search history.

(56) References Cited

U.S. PATENT DOCUMENTS

| | | | |
|---|---|---|---|
| 5,324,221 A | 6/1994 | Kaufman et al. | |
| 6,554,669 B1 * | 4/2003 | Motosko | B63C 9/155 441/129 |
| 7,207,857 B2 | 4/2007 | Zheng | |
| 11,065,179 B2 | 7/2021 | Baker | |

FOREIGN PATENT DOCUMENTS

| | | |
|---|---|---|
| CN | 204056266 U | 12/2014 |
| CN | 210191775 U | 3/2020 |
| DE | 1748124 U | 7/1957 |
| FR | 340831 | 12/1904 |
| FR | 2762792 | 11/1998 |

OTHER PUBLICATIONS

PCT International Application Publication No. WO 2007/019635; Feb. 22, 2007; PCT.
PCT International Application Publication No. WO 2013/160631, Oct. 31, 2013; PCT.
PCT International Application Publication No. WO 2020/233782: Nov. 26, 2020; PCT.

* cited by examiner

*Primary Examiner* — Lars A Olson
(74) *Attorney, Agent, or Firm* — Dennis D. Brown; Brown Patent Law, P.L.L.C.

(57) ABSTRACT

A hinged floatation device in which the two end portions of one elongate floatation panel are pivotably attached to the two end portions of another elongate floatation panel such that the floatation panels can be pivoted with respect to each other from a compact storage and carrying positioned, where one panel lies substantially flat against the other, to various deployed positions in which the two panels bow outwardly away from each other for sitting in the device while floating, laying on the device while floating, or floating in a vertical position with the device positioned around the user's torso.

10 Claims, 2 Drawing Sheets

FLOATATION DEVICE

FIELD OF THE INVENTION

The present invention relates to recreational water floatation devices.

BACKGROUND OF THE INVENTION

A continuing need exists for an improved recreational floatation device for use in swimming pools, lakes, streams, the ocean, etc. The improved recreational floatation device will preferably be (a) versatile and adaptable for multiple uses, (c) very low cost, (d) convenient to store, transport, carry, and use, and (e) effective for adults and youths.

SUMMARY OF THE INVENTION

The present invention provides a hinged floatation device which satisfies the needs mentioned above. The inventive floatation device is inexpensive and lightweight and can be pivoted to a range of different positions for, e.g., sitting in the device while floating, laying on the device while floating, or floating in a vertical position with the device positioned around the user's torso. When not in use, the hinged floatation device can be pivoted to a compact folded position which is very convenient for storing, transporting, and carrying.

In one aspect, there is provided a floatation device which preferably comprises: (a) a first floatation panel having a longitudinal length which exceeds a lateral width of the first floatation panel, with the first floatation panel also having a first side and a second side opposite the first side and (b) a second floatation panel having a longitudinal length which exceeds a lateral width of the second floatation panel, with the second floatation panel also having a first side and a second side opposite the first side of the second floatation panel. A first longitudinal end portion of the first floatation panel is pivotably attached to a first longitudinal end portion of the second floatation panel and a second longitudinal end portion of the first floatation panel is pivotably attached to a second longitudinal end portion of the second floatation panel. The first floatation panel is preferably pivotable with respect to the second floatation panel over a pivot range which extends from (i) an initial position, in which the first side of the first floatation panel faces, and lies substantially against, the first side of the second floatation panel, to at least (ii) a fully deployed position in which the first floatation panel is pivoted at least 90° with respect to the second floatation panel. When the first floatation panel is pivoted to the fully deployed position, the first and the second floatation panels are bowed outwardly.

In another aspect, the fully deployed position of the first floatation panel with respect to the second floatation panel will preferably be 180° from the initial position of the first floatation panel as identified above. In the fully deployed position, the first floatation panel is bowed outwardly away from the second floatation panel, the second floatation panel is bowed outwardly away from the first floatation panel, and the second side of the first floatation panel faces the first side of the second floatation panel.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
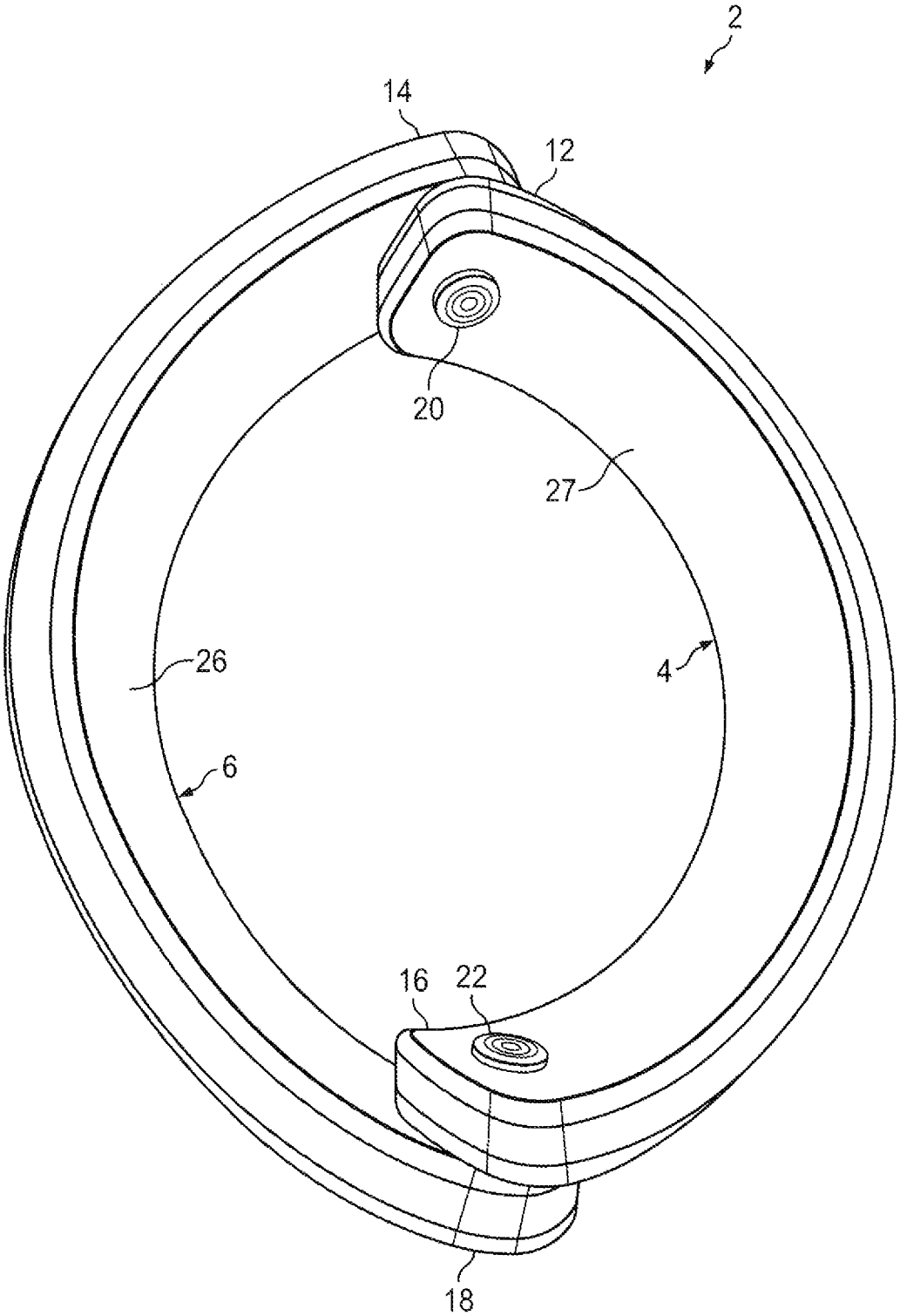
FIG. 1 is a perspective view of an embodiment 2 of the inventive recreational floatation device in a deployed position of about 120°.

An embodiment 2 of the inventive recreational floatation device is illustrated in FIGS. 1-4. The inventive floatation device 2 preferably comprises a first floatation panel 4 and a second floatation panel 6, each of which has a longitudinal length 8 which exceeds that lateral width 10 of the floatation panel 4 or 6.

The first floatation panel 4 is connected to the second floatation panel 6 in a hinged manner wherein: (a) a first longitudinal end portion 12 of the first floatation panel 4 is pivotably attached to a first longitudinal end portion 14 of the second floatation panel 6 and (b) a second longitudinal end portion 16 of the first floatation panel 4 is pivotably attached to a second longitudinal end portion 18 of the second floatation panel 6.

The first longitudinal end portion 12 of the first floatation panel 4 is preferably pivotably attached to the first longitudinal end portion 14 of the second floatation panel 6 by a first hinge pin 20 which extends through (i) the first longitudinal end portion 12 of the first floatation panel 4 and (ii) the first longitudinal end portion 14 of the second floatation panel 6. Similarly, the second longitudinal end portion 16 of the first floatation panel 4 is preferably pivotably attached to the second longitudinal end portion 18 of the second floatation panel 6 by a second hinge pin 22 which extends through (i) the second longitudinal end portion 16 of the first floatation panel 4 and (ii) the second longitudinal end portion 18 of the second floatation panel 6.

Figure 2:
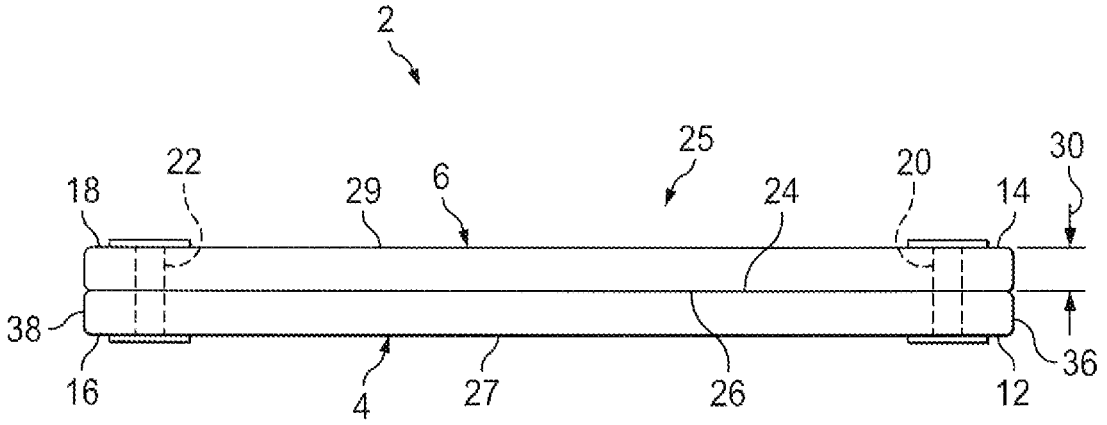
FIG. 2 is a top view of the inventive floatation device 2 in an initial (folded) position.
Figure 3:
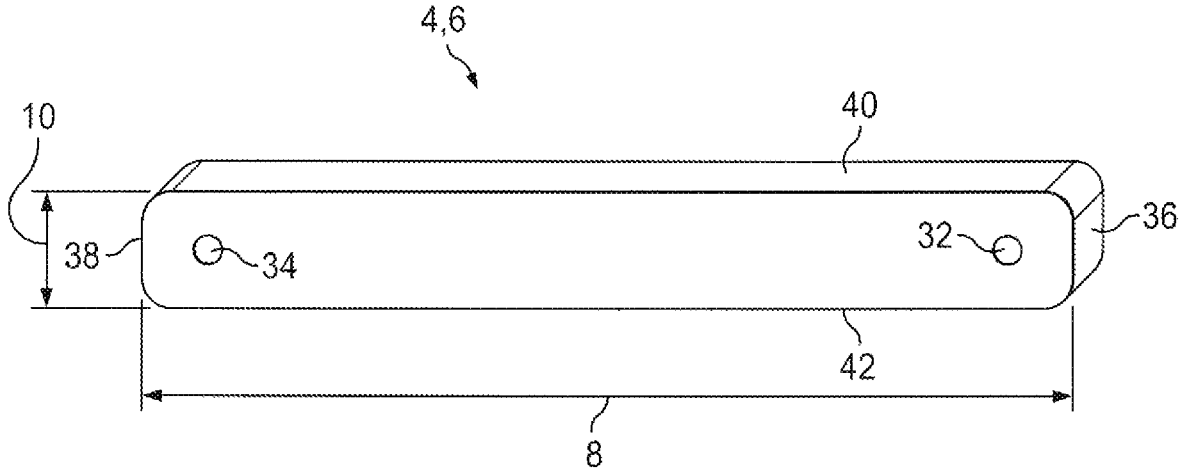
FIG. 3 is a perspective view of a first or second floatation panel 4 or 6 used in the inventive floatation device 2.

As illustrated in FIG. 2, the inventive floatation device 2 is pivotable to a compact folded position 25 (also referred to herein and in the claims as an "initial position") for storage and carrying. In the initial or folded position 25, a first side 24 of the first floatation panel 4 faces, and lies substantially against, a first side 26 of the second floatation panel 6. As used herein and in the claims, the term "substantially against" means that (i) the entire first side 24 of the first panel 4 is in contact with the entire first side 26 of the second panel or that (ii) the center of the first side 24 of the first panel 4 is spaced not more than 1 inch from the center of the first side 26 of the second panel 6.

In the folded position 25, the inventive floatation device 2 will preferably be substantially flat, i.e., will either be flat or will not bend or curve more than 15°. Also in the folded position 25, the second side 27 of the first floatation panel 4 (i.e., the side of the panel 4 opposite the first side 24) faces away from the second floatation panel 6 and the second side 29 of the second floatation panel 6 (i.e., the side of the panel 6 opposite the first side 26) faces away from the first floatation panel 4.

Due to the hinged connection between the first and the second floatation panels 4 and 6, the first panel 4 is pivotable about the hinge pins 20 and 22 with respect to the second panel 6 to at least a fully deployed position of the first floatation panel 4. The fully deployed position of the first floatation panel 4 is preferably at least 90° from the folded position 25 illustrated in FIG. 2. More preferably, the fully deployed position of first floatation panel 4 is at least 100°, or at least 120°, or at least 140°, or at least 160°, or at least 170°, or is 180°, from the folded position 25. The first floatation panel 4 is most preferably pivotable with respect to the second floatation panel 6 over a pivot range of 360° from the folded position 25, with the fully deployed position of the first floatation panel 4 being at 180° from the initial position 25.

As the first floatation panel 4 is pivoted with respect to the second floatation panel 6 from the folded position 25 to the fully deployed position of the panel 4, each of the floatation panels 4 and 6 bows outwardly with respect to the other floatation panel 4 or 6. In addition, the first side 24 of the first panel 4 turns away from the first side 26 of the second panel 6. When the pivoted position of the first floatation panel 4 approaches or reaches 180° from the folded position 25, the second side 27 of the first panel 4 faces the first side 26 of the second panel 6 and the first side 24 of the first panel 4 now faces away from the second panel 6. In addition, when the inventive floatation device 2 is pivoted from the folded position 25, in which the inventive device 2 is substantially flat, to a fully deployed position of 180°, the fully deployed floatation device 2 bows outwardly to a circular or near circular oval shape.

By way of example, but not by way of limitation, when the first panel 4 is pivoted 90° from the folded position 25, the user can float in a sitting position. i.e., a position in which the user is sitting on the first floatation panel 4 and the user's arms are resting on the second floatation panel 6. When the first floatation panel 4 is pivoted to or close to 180° from the folded position 25, the user can float in a reclining position in which the user's back rests on the first panel 4 and the user's legs hang over the second panel 6. Alternatively, when the first floatation panel 4 is pivoted 180° from the folded position 25, the user can float in a vertical position in which the inventive floatation device 2 extends around the user's torso and the user's arms rest on the first floatation panel 4 and/or the second floatation panel 6.

The floatation panels 4 and 6 can be formed of substantially any buoyant material used for forming recreational floatation devices. The panels 4 and 6 will preferably be formed of a closed cell foam material.

The floatation panels 4 and 6 will preferably be identical in structure and shape. Each floatation panel 4 and 6 will preferably be a flat, elongate panel having: (i) a longitudinal length 8 in the range of from 43 inches to 52 inches (more preferably from 45 inches to 50 inches); a lateral width 10 in the range of from 4 inches to 7 inches (more preferably from 5 to 6 inches); and a thickness 30 in the range of from 1 inch to 3 inches (more preferably from 1.5 to 2.5 inches).

Each floatation panel 4 and 6 will also preferably have a pair of holes 32 and 34 extending therethrough for receiving the hinge pins 20 and 22. The hole 32 (and the hinge pin 20 extending therethrough) will preferably be located from 2 inches to 3.5 inches from the end 36 of the panel 4 or 6. Similarly, the hole 34 (and the hinge pin 22 extending therethrough) will preferably be located from 2 inches to 3.5 inches from the opposite end 38 of the panel 4 or 6.

The hole 32 of the floatation panel 4 or 6 will more preferably be centered such that the hole 32 (and the hinge pin 20 extending therethrough) will be equidistant from the end 36, the upper lateral edge 40, and the lower lateral edge 42 of the panel 4 or 6. Similarly, the hole 34 of the floatation panel 4 or 6 will preferably be centered such that the hole 34 (and the hinge pin 22 extending therethrough) will be equidistant from the end 38, the upper lateral edge 40, and the lower lateral edge 42 of the panel 4 or 6.

Each of the hinge pins 20 and 22 can generally be any type of structure, preferably a cylindrical structure, which is effective for pivotably connecting the floatation panels 4 and 6 together and is formed of plastic or other material which is suitable for use in water.

Figure 4:
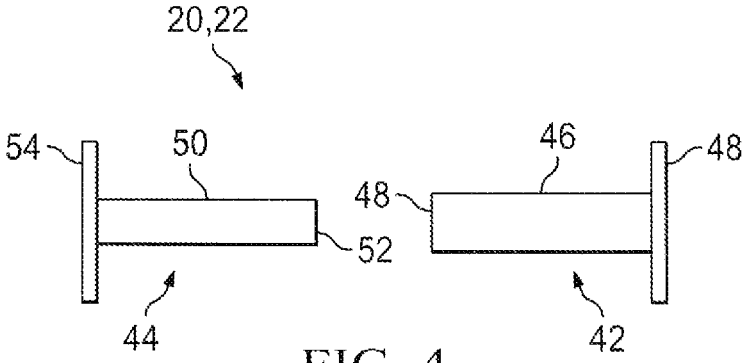
FIG. 4 is an exploded view of a first or second hinge pin 20 or 22 used in the inventive floatation device 2.

By way of example, but not by way of limitation, each of the hinge pins 20 and 22 can be a hinge ping structure of the type illustrated in FIG. 4 which comprises a first piece 42 and a second piece 44. The first piece 42 comprises (i) a cylindrical tube segment 46 having an inside diameter and an open end 48 and (ii) a radially extending cap 48 on the opposite end of the tube segment 46. The second piece 44 comprises (i) a tube or rod segment 50 having a forward end 52 and an outside diameter which is less than the inside diameter of the cylindrical tube segment 46 of the first piece 42 and (ii) a radially extending cap 54 on the rearward end of the tube or rod segment 50. The tube or rod segment 50 of the second piece 44 is receivable or is received in the cylindrical tube segment 46 of the first piece 42 and can be secured therein using a glue or other bonding material, or by forming or using mechanical clips or other clipping or locking elements on or in the first and/or second pieces 42 and 44 of the hinge pins 20 and 22.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A floatation device comprising:

a first floatation panel having a longitudinal length which exceeds a lateral width of the first floatation panel, and the first floatation panel also having a first side and a second side opposite the first side;

a second floatation panel having a longitudinal length which exceeds a lateral width of the second floatation panel, and the second floatation panel also having a first side and a second side opposite the first side of the second floatation panel;

a first longitudinal end portion of the first floatation panel being pivotably attached to a first longitudinal end portion of the second floatation panel and a second longitudinal end portion of the first floatation panel being pivotably attached to a second longitudinal end portion of the second floatation panel;

the first floatation panel being pivotable with respect to the second floatation panel over a pivot range which extends from (a) an initial position, in which the first side of the first floatation panel faces, and lies substantially against, the first side of the second floatation panel, to at least (b) a fully deployed position in which the first floatation panel is pivoted at least 90° with respect to the second floatation panel;

when the first floatation panel is pivoted to the fully deployed position, the first and the second floatation panels are bowed outwardly;

the first longitudinal end portion of the first floatation panel being pivotably attached to the first longitudinal end portion of the second floatation panel by a first pin which extends through the first longitudinal end portion of the first floatation panel and the first longitudinal end portion of the second floatation panel; and the second longitudinal end portion of the first floatation panel being pivotably attached to the second longitudinal end portion of the second floatation panel by a second pin which extends through the second longitudinal end portion of the first floatation panel and the second longitudinal end portion of the second floatation panel.

2. The floatation device of claim 1 further comprising:

the fully deployed position of the first floatation panel with respect to the second floatation panel being 180° from the initial position;

the first floatation panel being bowed outwardly away from the second floatation panel and the second floatation panel being bowed outwardly away from the first floatation panel when the first floatation panel is pivoted to the fully deployed position; and the second side of the first floatation panel facing the first side of the second floatation panel when the first floatation panel is pivoted to the fully deployed position.

3. The floatation device of claim 2 further comprising the pivot range of the first floatation panel with respect to the second floatation panel being a total of 360°, with the fully deployed position of the first floatation panel being 180°.

4. The floatation device of claim 1 further comprising:

the longitudinal length of the first floatation panel being in a range of 43 inches to 52 inches;

the lateral width of the first floatation panel being in a range of 4 inches to 7 inches;

the longitudinal length of the second floatation panel being in a range of 43 inches to 52 inches; and the lateral width of the second floatation panel being in a range of 4 inches to 7 inches.

5. The floatation device of claim 1 further comprising:

the longitudinal length of the first floatation panel being the same as the longitudinal length of the second floatation panel and the lateral width of the first floatation panel being the same as the lateral width of the second floatation panel.

6. The floatation device of claim 1 further comprising:

the first pin being located from 2 inches to 3.5 inches from a first longitudinal end of the first floatation panel and from 2 inches to 3.5 inches from a first longitudinal end of the second floatation panel and the second pin being located from 2 inches to 3.5 inches from a second longitudinal end of the first floatation panel and from 2 inches to 3.5 inches from a second longitudinal end of the second floatation panel.

7. The floatation device of claim 1 further comprising each of the first and the second pins comprising:

a first piece comprising (i) a tube segment having an inside diameter and an open end and (ii) a radially extending cap on an opposite end of the tube segment;

a second piece comprising (i) a tube or rod segment having a forward end and an outside diameter which is less than the inside diameter of the tube segment of the first piece and (ii) a radially extending cap on a reward end of the tube or rod segment of the second piece; and the tube or rod segment of the second piece being received or receivable in the tube segment of the first piece.

8. The floatation device of claim 7 further comprising the tube or rod segment of the second piece being received and bonded in the tube segment of the first piece.

9. The floatation device of claim 1 further comprising each of the first and the second floatation panels being formed of a closed cell foam material.

10. A floatation device comprising:

a first floatation panel having a longitudinal length which exceeds a lateral width of the first floatation panel, and the first floatation panel also having a first side and a second side opposite the first side;

a second floatation panel having a longitudinal length which exceeds a lateral width of the second floatation panel, and the second floatation panel also having a first side and a second side opposite the first side of the second floatation panel;

a first longitudinal end portion of the first floatation panel being pivotably attached to a first longitudinal end portion of the second floatation panel and a second longitudinal end portion of the first floatation panel being pivotably attached to a second longitudinal end portion of the second floatation panel;

the first floatation panel being pivotable with respect to the second floatation panel over a pivot range which extends from (a) an initial position, in which the first side of the first floatation panel faces, and lies substantially against, the first side of the second floatation panel, to at least (b) a fully deployed position in which the first floatation panel is pivoted at least 90° with respect to the second floatation panel;

when the first floatation panel is pivoted to the fully deployed position, the first and the second floatation panels are bowed outwardly;

the fully deployed position of the first floatation panel with respect to the second floatation panel being 180° from the initial position;

the first floatation panel being bowed outwardly away from the second floatation panel and the second floatation panel being bowed outwardly away from the first floatation panel when the first floatation panel is pivoted to the fully deployed position;

the second side of the first floatation panel facing the first side of the second floatation panel when the first floatation panel is pivoted to the fully deployed position; and the pivot range of the first floatation panel with respect to the second floatation panel being a total of 360°, with the fully deployed position of the first floatation panel being 180°.

* * * * *